United States Patent [19]

Ishiguro et al.

[11] Patent Number: 4,955,805

[45] Date of Patent: Sep. 11, 1990

[54] CHECK-VALVE MECHANISMS FOR A PULSE COMBUSTION APPARATUS

[75] Inventors: Katsusuke Ishiguro, Nagoya; Tsuneyasu Hayakawa, Kani; Nobuyoshi Yokoyama, Toyoake, all of Japan

[73] Assignee: Paloma Kogyo Kabushiki Kaisha, Aichi, Japan

[21] Appl. No.: 310,335

[22] Filed: Feb. 13, 1989

[30] Foreign Application Priority Data

Jun. 4, 1988 [JP] Japan ..... 63-137963

[51] Int. Cl.[5] ..... F23C 11/04

[52] U.S. Cl. ..... 431/1; 137/512.1

[58] Field of Search ..... 431/1; 122/24; 60/249, 60/39.76, 39.77, 39.8; 137/512.1

[56] References Cited

U.S. PATENT DOCUMENTS 4,687,435 8/1987 Matsuzaka et al. ..... 431/1
4,715,807 12/1987 Yokoyama et al. ..... 431/1
4,752,209 6/1988 Vishwanath et al. ..... 431/1

FOREIGN PATENT DOCUMENTS 53-106510 8/1978 Japan .

*Primary Examiner*—Carl D. Price
*Attorney, Agent, or Firm*—Lahive & Cockfield

[57] ABSTRACT

A check-valve mechanism of a pulse combustion apparatus for passing air into a mixing chamber includes (i) a partition wall separating an air inlet chamber and the mixing chamber from each other, (ii) a plurality of rear discs of relatively small diameters spaced apart from the partition wall and located inside the mixing chamber, and (iii) a plurality of front discs, or valve members, located between said partition wall and said rear discs; respectively. The circular portions of the partition wall which overlies the respective valve members (as viewed from the side of the air inlet chamber) each have a plurality of radially-extended elongate openings for passing air into the mixing chamber. Each rear disc has a plurality of small circular openings. Each valve member is axially movable between the partition wall and the associated rear disc, thereby opening and closing the elongate openings. A check-valve mechanism for passing fuel gas into a gas distributing chamber includes (i) an outlet-side wall of a fuel gas intlet chamber, (ii) a rear disc spaced apart from the outlet-side wall in a downstream direction and located outside the gas inlet chamber, and (iii) a front disc, or valve member, located between the foregoing outlet-side wall and the rear disc. The outlet-side wall of the gas inlet chamber has a plurality of radially-extended elongate openings for passing fuel gas into the gas distributing chamber.

2 Claims, 4 Drawing Sheets

CHECK-VALVE MECHANISMS FOR A PULSE COMBUSTION APPARATUS

FIELD OF THE INVENTION

This invention relates to check-valve mechanisms for a pulse combustion apparatus used for the heating of liquid, and more particularly to a check-valve mechanism for passing air into a mixing chamber and a check-valve mechanism for passing fuel gas into the mixing chamber.

BACKGROUND OF THE INVENTION

As is well known in the art, in a pulse combustion apparatus air and fuel gas are initially forced into a mixing chamber where the air and the gas are mixed. The mixture is supplied into a combustion chamber where the mixture is ignited in a forced manner, or by an igniting means. Once combustion starts normally in the combustion chamber, the apparatus is "self-sustaining". To be more exact, once combustion starts normally therein, it is no longer necessary to force air and fuel gas into the mixing chamber in order to continue combustion. Instead the combustion chamber draws, by itself, subsequent air and fuel gas through the mixing chamber thanks to the negative pressure which is created, within the combustion chamber, by the initial combustion products produced therein and flowing into a tail pipe. Nor is it necessary to ignite the subsequent air/fuel mixture by the igniting means, but the subsequent mixture ignites itself. This "self-ignition" comes from the possibility that a portion of the initial burned gas which has flowed into the tail pipe may return into the combustion chamber or from the possibility that a portion of the initial burned gas may remain in the combustion chamber. Such a portion of the initial burned gas ignites the subsequent mixture. Thus, in the apparatus, a series of air/fuel mixture supply, ignition, expansion and exhaust occurs in, for example, some 80 to 100 cycles per second. A check-valve mechanism for passing air into the mixing chamber and a check-valve mechanism for passing fuel gas thereinto each are opened and closed in the same cycles as the foregoing series of air/fuel mixture supply, ignition, expansion and exhaust occurs. Thus the check-valve mechanisms are opened and closed at very high rates.

In the conventional pulse combustion apparatus for heating liquid, the check-valve mechanism for passing air into the mixing chamber comprises (i) a circular partition wall separating an air inlet chamber and the mixing chamber from each other, (ii) a plurality of front discs, or valve members, and (iii) a plurality of rear discs. The rear discs are located inside the mixing chamber, and are axially spaced apart from the partition wall by approximately 1.5 to 1.8 millimeters. Each rear disc has a much smaller diameter than the partition wall. The rear discs are arranged with equal intervals, and form, as a whole, a ring which is smaller in diameter than the partition wall, but is concentric with the partition wall. The number of the valve members is the same as that of the rear discs. The valve members are located between the partition wall and the rear discs. Each valve member has a little smaller diameter than the rear disc. The valve members are coaxial with the respective rear discs, and overlie the respective rear discs as viewed from the inlet side of the mixing chamber. Each rear disc has a plurality of small circular openings through which air may pass. Also, the partition wall has a plurality of small circular openings in the portions thereof which correspond to, or coincide with, the respective rear discs. Thus the mixing chamber communicates with the air inlet chamber through the circular openings of the partition wall. Air to be mixed with fuel gas flows into the air inlet chamber, and passes through the openings of the partition wall into the mixing chamber. Each valve member, the associated perforated portion of the partition wall and the associated rear disc have central large openings, and are joined together by means of a common bolt which passes through the central large openings thereof. Each valve member, the associated perforated portion of the partition wall and the associated rear disc, as a whole, constitute a valve section. Each valve member is axially movable between the partition wall and the associated rear disc.

On the other hand, the check-valve mechanism for passing fuel gas into the mixing chamber, or more particularly into a gas distributing chamber, comprises (i) a circular outlet-side wall of a gas inlet chamber, (ii) a single front disc, or valve member, and (iii) a single rear disc. The rear disc is spaced apart from the outlet-side wall of the gas inlet chamber by substantially the same distance as each rear disc of the foregoing check-valve mechanism for air is spaced apart from the partition wall thereof. The rear disc is located outside the gas inlet chamber, and is on a downstream side of the gas inlet chamber. The valve member is located between the outlet-side wall of the gas inlet chamber and the rear disc. The valve member has a little smaller diameter than the rear disc. The rear disc, the valve member and the outlet-side wall of the gas inlet chamber each have a central large opening, and are joined together by means of a common bolt which passes through the central openings thereof. The outlet-side wall of the gas inlet chamber has a plurality of small circular openings. Fuel gas enters the gas inlet chamber, and comes therefrom through these small circular openings. The rear disc also has a plurality of small circular openings through which the gas may pass. The valve member is axially movable between the outlet-side wall of the gas inlet chamber and the rear disc. Thus, the construction of the check-valve mechanism for fuel gas is the same as the construction of each valve section of the check-valve mechanism for air.

Initially air and fuel gas are forced into the mixing chamber. Air blown from a blower enters the air inlet chamber, passes through the circular openings of the partition wall separating the air inlet chamber and the mixing chamber from each other, and enters the mixing chamber. Fuel gas supplied separately from the air enters a gas chamber, and flows into the gas inlet chamber. The gas passes through the circular openings of the outlet-side wall of the gas inlet chamber, and flows into the gas distributing chamber. From the gas distributing chamber the gas is supplied into the mixing chamber. The air and the gas are thus mixed in the mixing chamber. The mixture flows through a flame trap into the combustion chamber. The initial mixture thus supplied into the combustion chamber is ignited in a forced manner, or by an ignition plug. As mentioned before, when the initial mixture is normally ignited to start combustion normally in the combustion chamber, the combustion chamber draws, by itself, subsequent air and fuel gas through the mixing chamber thanks to the negative pressure which is created, within the combustion chamber, by the initial combustion products produced therein and flowing into a tail pipe. Also as mentioned before, the subsequent mixture drawn into the combustion chamber ignites itself.

As mentioned before, such a series of air/fuel mixture supply, ignition, expansion and exhaust occurs in, for example, some 80 to 100 cycles per second. The check-valve mechanisms for passing air into the mixing chamber and for passing fuel gas thereinto each are opened and closed in the same cycles as the series of air/fuel mixture supply, ignition, expansion and exhaust occurs.

Thus the check-valve mechanisms are opened and closed at very high rates per second. When the mixture has been ignited, the combustion chamber has therein a pressure which is considerably higher than the atmospheric pressure. This positive pressure causes the valve members of the check-valve mechanism for air to move to the upstream side and strike the foregoing partition wall. Thus the small circular openings of the perforated portions of the partition wall associated with the respective valve members are closed by the respective valve members, and therefore the entire check-valve mechanism for air is closed. Simultaneously with the closing of this check-valve mechanism, the valve member of the check-valve mechanism for fuel gas also moves to the upstream side and strikes the outlet-side wall of the gas inlet chamber, due to the foregoing positive pressure. Thus the small circular openings of this outlet-side wall are closed by the valve member, and therefore the check-valve mechanism for fuel gas is also closed. After the combustion has taken place in the combustion chamber, the combustion products produced in the combustion chamber flows into the tail pipe, thus reducing the pressure in the combustion chamber below the atmospheric pressure. Then, thanks to the negative pressure thus created in the combustion chamber, subsequent air and fuel are drawn, and causes the valve members of the check-valve mechanism for air and of the check-valve mechanism for fuel gas, respectively, to move away from the associated walls to the downstream sides. Thus the circular openings of the foregoing partition wall and the circular opening of the foregoing outlet-side wall are opened, and therefore the two check-valve mechanisms are opened. The subsequent air and fuel gas are thus supplied.

Thus it may be said that each valve member vibrates axially between the associated wall and the associated rear disc at very high rates per second.

As mentioned above, when the valve members of the checkvalve mechanisms have moved to the upstream sides, the valve members strike the respective associated walls. And when the valve members have struck these walls, the portions of each valve member which closes the circular openings of the associated wall project, or are sucked, into the circular openings to certain degrees. Thus, the portions of each valve member which strike the edges of the circular openings of the associated wall are damaged to certain degrees each time the valve member strikes the associated wall. Therefore, the valve members are damaged out of use sooner or later.

The valve members also strike the respective associated rear discs when the valve members have moved away from the associated walls to the downstream sides. When striking the rear discs, however, the valve members are hardly damaged. The reason for this is that the difference between the atmospheric pressure and the negative pressure in the combustion chamber when the latter pressure has been produced in the combustion chamber is very much smaller than the difference between the positive pressure in the combustion chamber and the atmospheric pressure when the former pressure has been produced in the combustion chamber.

If openings with much smaller sizes than in the prior art may be made, as passages for fluid, through the foremost member of the check-valve mechanism, the service life of the valve member can be prolonged considerably. However, as long as circular openings are made, the sizes thereof cannot be made much smaller since the smaller the openings, the smaller the amount of fluid passing therethrough becomes. Researches conducted by the inventors have shown that if the sizes, or diameters, of the circular openings are reduced below 2 or 3 millimeters, a sufficient rate of flow of fluid cannot be ensured therethrough.

Also, the pulse combustion apparatus may be subjected to high temperatures of more than 300° C. The conventional valve member comprises a sheet metal or a woven fabric of glass fiber coated with resin. However, the valve member of such materials can provide only a very short service life under the severe thermal conditions.

SUMMARY OF THE INVENTION

The object of the invention is to provide, for a liquid-heating pulse combustion apparatus, check-valve mechanisms for passing air into a mixing chamber and for passing fuel gas into a gas distributing chamber wherein valve members are enabled to provide considerably longer service lives than the valve members of the check-valve mechanisms of the conventional liquid-heating pulse combustion apparatus.

Researches conducted by the inventors have revealed that if elongate openings are made through the foremost member of a check-valve mechanism as passages for fluid, the valve member thereof can be prolonged considerably while allowing the necessary amount of fluid to pass therethrough. The inventors also have found that a valve member formed of a woven or nonwoven fabric of carbon fiber coated with fluorocarbon resin provides a considerably longer service life under severe thermal conditions. For example, a valve member of such materials can provide substantially eight times the service life of a valve member with glass fiber as a core material.

BRIEF DESCRIPTION OF THE DRAWING

In FIG. 3 this check-valve mechanism is viewed from an upstream side;

In FIG. 4 this valve section is also viewed from the upstream side;

In FIG. 5 this valve section is also viewed from the upstream side;

In FIG. 7 this check-valve mechanism is viewed from the upstream side;

In FIG. 8 this construction is also viewed from the upstream side;

In FIG. 9 this construction is also viewed from the upstream side:

DETAILED DESCRIPTION OF PREFERRED EMBODIMENTS

Figure 1:
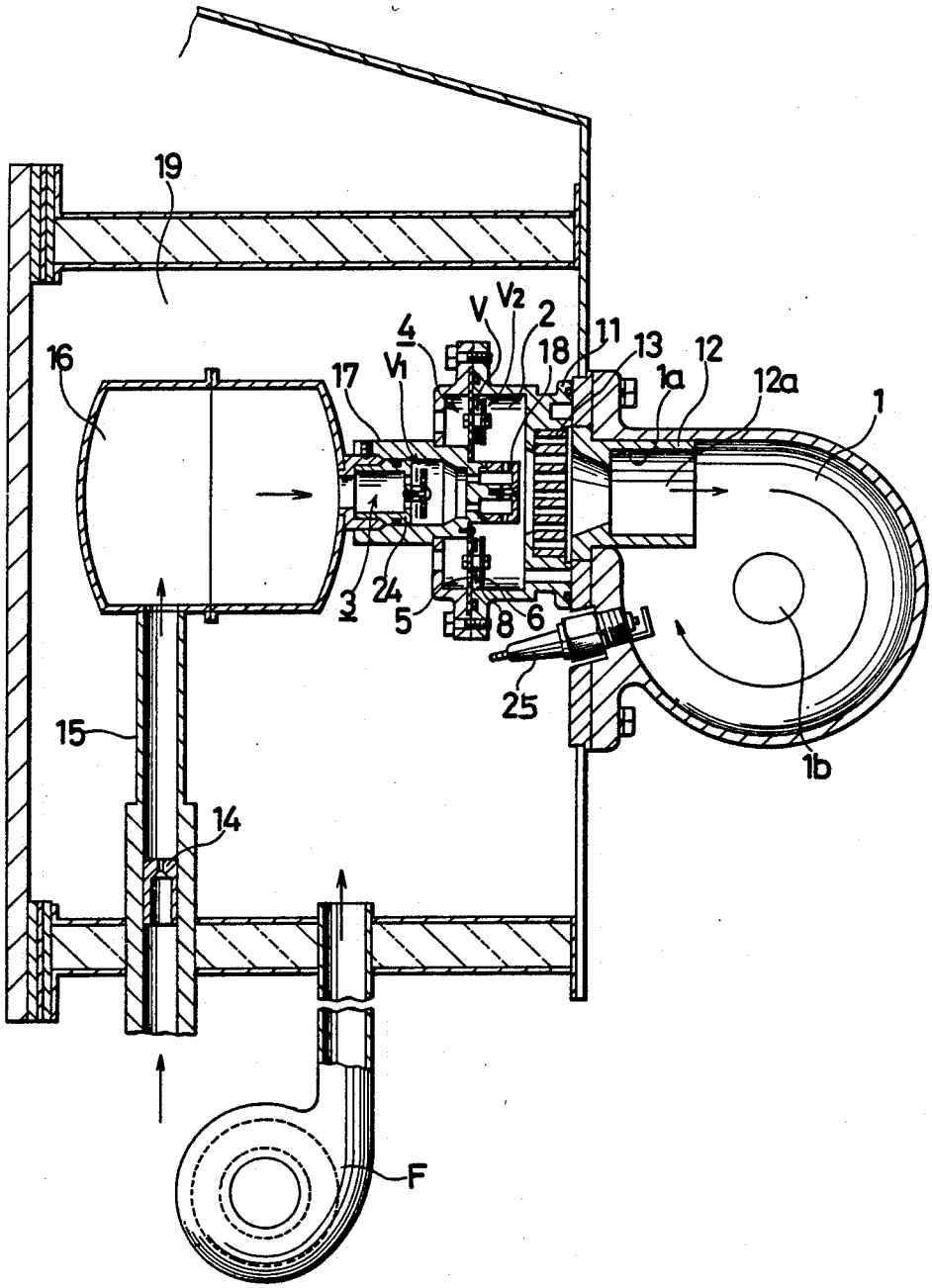
FIG. 1 is a cross section of a pulse combustion apparatus having check-valve mechanisms according to the invention.
Figure 2:
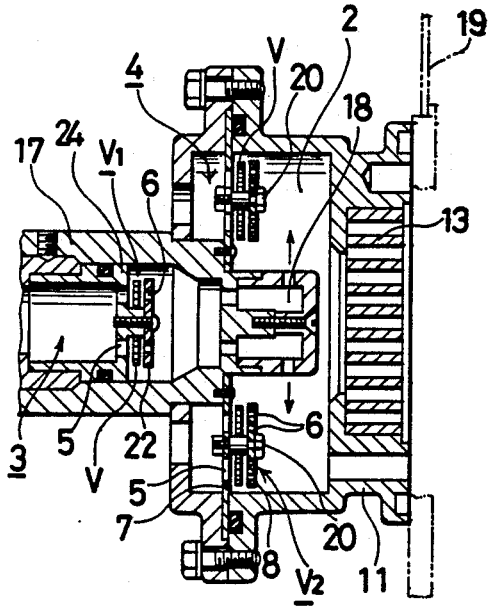
FIG. 2 is an enlarged view of a portion of the apparatus of FIG. 1 in which the check-valve mechanisms are provided.

Referring now to the drawing, a pulse combustion apparatus of FIG. 1 includes a combustion chamber 1 having an inlet 12*a* for introducing an air/fuel mixture into the chamber and an outlet lb from which burned gas comes out of the chamber. Numeral 2 designates a mixing chamber. A flame trap 13 is located between the mixing chamber 2 and the combustion chamber 1. An air inlet chamber 4 is located on an upstream side of the mixing chamber 2. The chambers 4 and 2 are separated from each other by a circular partition wall 7 (FIG. 2). Numeral 18 designates a gas distributing chamber. A gas inlet chamber 3 is located on an upstream side of the chamber 18.

Figure 3:
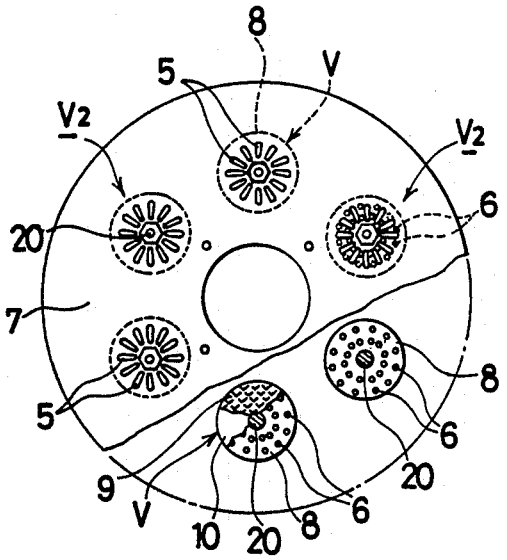
FIG. 3 shows one of the check-valve mechanisms, namely, a check-valve mechanism for passing air into a mixing chamber.
Figure 4:
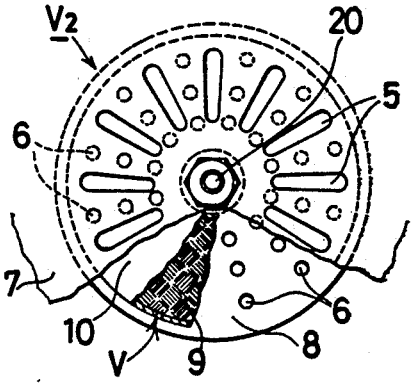
FIG. 4 shows a valve section which the check-valve mechanism of FIG. 3 may have.
Figure 5:
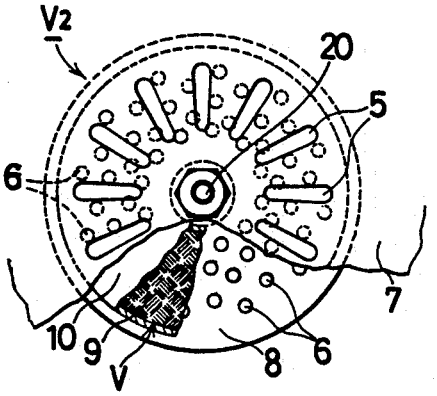
FIG. 5 shows another valve section which the check-valve mechanism of FIG. 3 may have.

Referring to FIGS. 2 and 3 in particular, a plurality of discs 8 are located inside the mixing chamber 2. The discs 8 are axially spaced apart from the partition wall 7 by a very small distance, illustratively by 1.65 millimeters. Each disc 8 has a much smaller diameter than the partition wall 7 (FIG. 3). The discs 8 are arranged with equal intervals, and form, as a whole, a ring which is smaller in diameter than the partition wall 7, but is concentric with the partition wall 7. Also, discs, or valve members, V are located between the partition wall 7 and the discs 8. The number of the valve members V is the same as that of the rear discs 8. Each valve member V has a little smaller diameter than the rear disc 8 (FIGS. 4 and 5). The valve members V are coaxial with the respective rear discs 8, and overlie the respective rear discs 8 as viewed from the upstream side of the mixing chamber 2. Each rear disc 8 has a plurality of small circular openings 6 through which air may pass. Each rear disc 8, the associated valve member V and the circular portion of the wall 7 which overlies the valve member V as viewed from the upstream side of the mixing chamber 2 have central large openings coincident with each other, and are joined together by means of a common bolt 20 which passes through these central openings.

The above-mentioned construction involving the partition wall 7, the valve members V and the rear discs 8 are the same as the greater part of the construction of the conventional check-valve mechanism for air as described in the BACKGROUND OF THE INVENTION. A difference is that each of the circular portions of the partition wall of the conventional check-valve mechanism for air which overlie the respective valve members thereof (as viewed from the upstream side of the mixing chamber) has small circular openings around the central large opening thereof, whereas each of the circular portions of the partition wall 7 of the invention which overlie the respective valve members V as viewed from the foregoing side does not have any small circular openings, but instead has elongate openings 5 around the central large opening thereof. As clearly illustrated in FIG. 4 or 5, the elongate openings 5 extend radially of the circular portion of the wall 7.

The air inlet chamber 4 thus communicates with the mixing chamber 2 through the elongate openings 5 of the partition wall 7. The wall 7, the valve members V and the rear discs 8 constitute a check-valve mechanism for passing air into the mixing chamber 2. Each valve member V, the associated perforated portion of the wall 7 (i.e., the associated circular portion of the wall 7 having the elongate openings 5) and the associated rear disc 8, as a whole, constitute a valve section $V_2$. Thus the above-mentioned check-valve mechanism for air includes a plurality of valve sections V2. The valve member V of each valve section $V_2$ is axially movable between the associated perforated portion of the wall 7 and the associated rear disc 8.

Referring to FIG. 2 in particular, the gas inlet chamber 3 has a circular outlet-side wall 24. A single disc 22 is spaced apart from the wall 24 in a downstream direction, and is located outside the chamber 3. A single disc, or valve member, V is also located between the wall 24 and the disc 22. The wall 24 and the discs V and 22 each have a central large opening, and are joined together by means of a common bolt. The rear disc 22 has a plurality of small circular openings. On the other hand, the wall 24 has a plurality of elongate openings 5 around its central large opening. These elongate openings 5 extend radially of the circular wall 24. The valve member V is axially movable between the wall 24 and the rear disc 22. The wall 24, the valve member V and the rear disc 22 constitute a check-valve mechanism for passing fuel gas into the gas distributing chamber 18. Thus, this check-valve mechanism for fuel gas has the same construction as each valve section $V_2$ of the foregoing check-valve mechanism for air. And, hence, this check-valve mechanism for fuel gas has the same construction as the conventional one as described in the BACKGROUND OF THE INVENTION except that the wall 24 of the former has the elongate openings 5 instead of small circular openings.

Each elongate opening of the wall 7 or 24 may have a width of, for example, 1.2 millimeters.

Air flows from an air chamber 19 into the air inlet chamber 4. From the chamber 4 the air passes through the elongate openings 5 of the partition wall 7 into the mixing chamber 2, moving the valve members V away from the wall 7. On the other hand, fuel gas is introduced through a conduit 15 into a gas chamber 16. From the chamber 16 the gas flows into the gas inlet chamber 3. From the chamber 3 the gas passes through the elongate openings 5 of the wall 24 of the chamber 3 toward the gas distributing chamber, moving the valve member V away from the wall 24. Then the gas flows into the gas distributing chamber 18, and thence into the mixing chamber 2. The gas and the air are thus mixed in the chamber 2. The mixture flows through the flame trap 13 into the combustion chamber 1.

Numeral 14 designates a nozzle.

The letter F designates a blower. Initially the blower F is operated to supply air in a forced manner.

Initially in the chamber 1 the mixture is ignited by an ignition plug 25 provided through the wall which defines the chamber 1. When the mixture has been ignited, the chamber 1 has therein a pressure which is considerably higher than the atmospheric pressure. Thus the valve members V of the two check-valve mechanisms are moved upstream, and strike the respective walls 7 and 24. Hence the elongate openings 5 of the walls 7 and 24 are closed. That is, both the check-valve mechanisms are closed. When the combustion products produced in the combustion chamber 1 flow into a tail pipe, the pressure in the chamber 1 is reduced below the atmospheric pressure. Thus fresh air and fuel gas are drawn through the mixing chamber 2 into the combustion chamber 1.

A series of air/fuel mixture supply, ignition, expansion and exhaust occurs in, for example, some 80 to 100 cycles per second. Each check-valve mechanism is opened and closed in the same cycles. Thus each mechanism is opened and closed at a very high rate. In other words, each valve member V is vibrated between the adjacent, other members of the check-valve mechanism at a very high rate.

Each valve member V may have a thickness of, for example, 0.4 millimeter.

Figure 10:
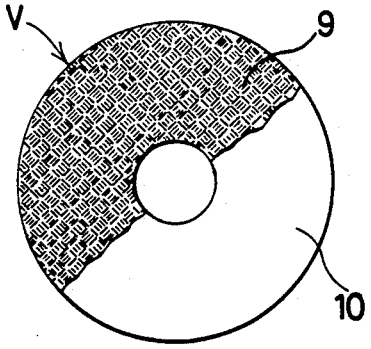
FIG. 10 shows a valve member which may be used for the check-valve mechanisms of the inventions.
Figure 11:
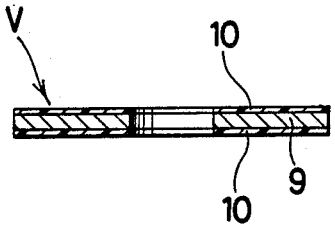
FIG. 11 is a cross section of the valve member of FIG. 10.
Figure 12:
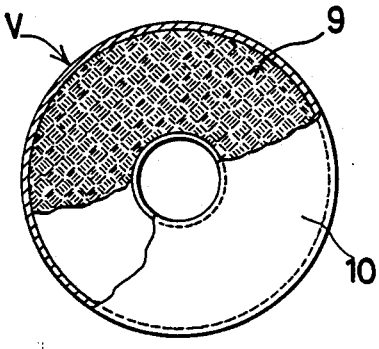
FIG. 12 shows another valve member which may be used for the check-valve mechanisms of the invention.
Figure 13:
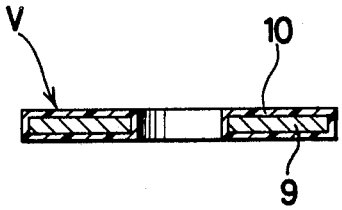
FIG. 13 is a cross section of the valve member of FIG. 12.
Figure 14:
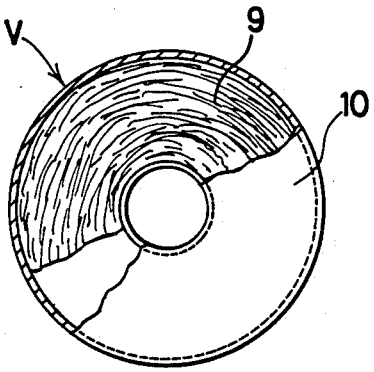
FIG. 14 shows still another valve member which may be used for the check-valve mechanisms of the invention.

Also, each valve member V may comprise, for example, the following:

(i) an annular woven fabric 9 of carbon fiber coated with fluorocarbon resin 10, such as polyethylene fluoride, at the opposed annular surfaces thereof (FIGS. 10 and 11);

(ii) an annular woven fabric 9 of carbon fiber coated with fluorocarbon resin 10, such as polyethylene fluoride, at the completely entire surface thereof (FIGS. 12 and 13); or (iii) an annular woven or nonwoven fabric 9 of carbon fiber coated with fluorocarbon resin 10, such as polyethylene fluoride, either at the opposed annular surfaces thereof or at the completely entire surface thereof (FIG. 14).

A woven or nonwoven fabric of carbon fiber is preferable as a core material of the valve member V because of its high flexibility, high fatigue strength under bending, high abrasion resistance, high heat resistance and its property of not vibrating too heavily. Also, fluorocarbon resin is preferable as an outer layer or layers of the valve member V because of its high heat resistance, high flexibility and nonadhesive property.

The valve member V vibrates between the other, adjacent members and strikes the other members, especially the wall 7 or 24, at a very rapid rate. In addition, the pulse combustion apparatus may be subjected to high temperatures of more than 300° C. However, according to the invention, the walls 7 and 24 have elongate openings and the valve member V is formed of the foregoing materials. Thus, the valve member V may provide a service life of more than 6,000 hours.

Figure 6:
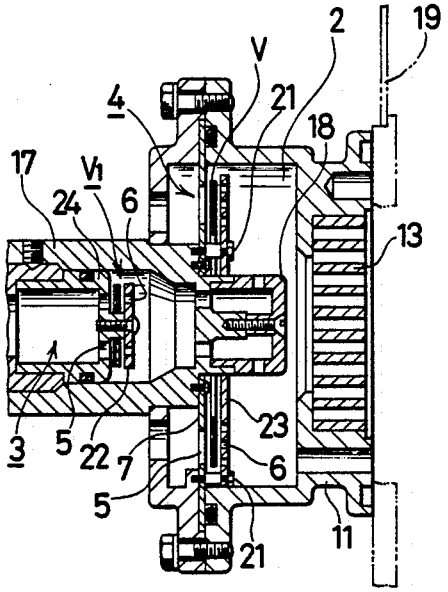
FIG. 6 is a view similar to FIG. 2, and shows another check-valve mechanism for passing air into the mixing chamber which may be used instead of the check-valve mechanism of FIG. 3.
Figure 7:
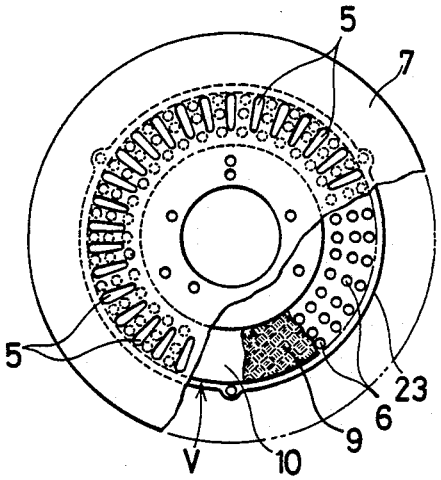
FIG. 7 shows the check-valve mechanism of FIG. 6 for passing air into the mixing chamber.

The foregoing check-valve mechanism for air may be modified as shown in FIGS. 6 and 7. In FIGS. 6 and 7 a valve member V and a rear member 23 each comprise a single continuous disc, or ring, instead of a plurality of small circular discs. The partition wall 7 has a plurality of radial elongate openings 5 around its central large opening. The rear member 23 has a plurality of small circular openings 6 in a portion thereof which substantially coincides with the annular portion of the wall 7 having the elongate openings 5. The valve member V is so arranged as to open and close the elongate openings 5 of the wall 7. The valve member V of such a modified checkvalve mechanism may also be formed of the foregoing materials.

Figure 8:
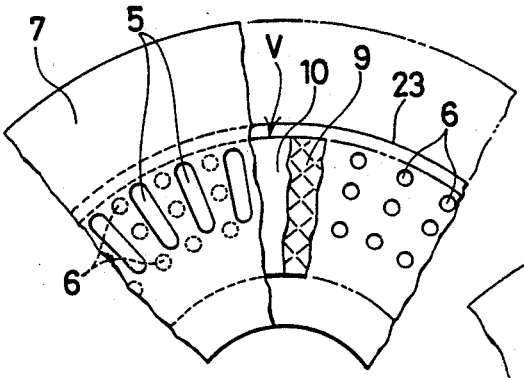
FIG. 8 is an enlarged view of a portion of a construction which the check-valve mechanism of FIG. 7 may have.
Figure 9:
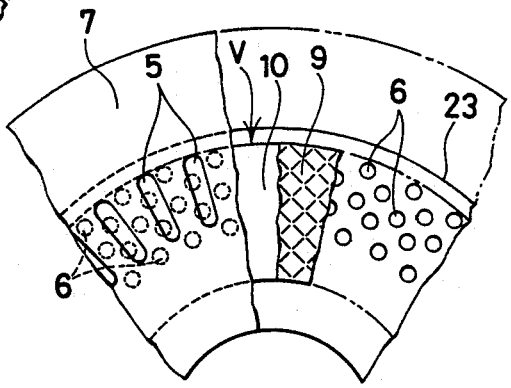
FIG. 9 is an enlarged view of a portion of another construction which the check-valve mechanism of FIG. 7 may have.

The service life of the valve member V may be prolonged if the elongate openings 5 of the wall 7 (or 24) and the circular openings 6 of the rear member (8, 22 or 23) are located relative to each other in such a manner that the openings 5 and 6 overlap each other as little as possible as viewed from an axial direction. FIGS. 4 and 8 each show an example where the openings 5 and 6 do not overlap each other at all. FIGS. 5 and 9 each show an example where the openings overlap each other a little. Needless to say, however, the possibility of avoiding such an overlapping depends upon how the openings 5 and 6 are crowded.

What is claimed is:

1. A check-valve mechanism of a pulse combustion apparatus for passing air into a mixing chamber, comprising (i) a partition wall separating an air inlet chamber and said mixing chamber from each other, (ii) a plurality of associated rear discs of relatively small diameters spaced apart from said partition wall and located inside said mixing chamber, (iii) a plurality of associated front discs, or valve members, of substantially the same diameters as said rear discs which are located between said partition wall and said rear discs and are each formed of woven fabric of carbon fiber coated with fluorocarbon resin, (iv) each said rear disc, the valve member associated therewith, and a circular portion of said partition wall which overlies the valve member as viewed from the side of said air inlet chamber each having a central opening and being joined together by bolt means which passes through the central openings thereof, (v) the circular portions of said partition wall each having around the central openings thereof a plurality of radially-extended elongated openings for passing air from said air inlet chamber into said mixing chamber, (vi) each said rear disc having around the central opening thereof a plurality of small circular openings which do not overlap the elongated openings of the circular portion of said partition wall corresponding to the rear disc as viewed from an axial direction, and (vii) each said valve member being axially movable between said partition wall and the associated rear disc, thereby opening and closing said elongated openings of the associated circular portion of said partition wall.

2. A check-valve mechanism of a pulse combustion apparatus for passing fuel gas from a fuel gas inlet chamber into a fuel gas distributing chamber, comprising (i) an outlet-side wall of said fuel gas inlet chamber, (ii) a single rear disc spaced apart from said outlet-side wall in a downstream direction and located outside said fuel gas inlet chamber, (iii) a single front disc, or valve member, located between said outlet-side wall and said rear disc and formed of woven fabric of carbon fiber coated with fluorocarbon resin, (iv) said outlet-side wall, said valve member and said rear disc having central openings and being joined together by bolt means which passes through the central openings thereof, (v) said outlet-side wall having around the central opening thereof a plurality of radially-extended elongate openings for passing fuel gas from said fuel gas inlet chamber into said fuel gas distributing chamber, (vi) said rear disc having around the central opening thereof a plurality of small circular openings which do not overlap the elongate openings of said outlet-side wall as viewed from an axial direction, and (vii) said valve member being axially movable between said outlet-side wall and said rear disc, thereby opening and closing said elongate openings.

* * * * *